US009668515B2

(12) United States Patent
Sinclair, Jr.

(10) Patent No.: US 9,668,515 B2
(45) **Date of Patent: *Jun. 6, 2017**

(54) TOBACCO PRODUCT

(71) Applicant: Blunt Wrap U.S.A., Inc., Mandeville, LA (US)

(72) Inventor: Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/887,781

(22) Filed: Oct. 20, 2015

(65) Prior Publication Data

US 2016/0106146 A1 Apr. 21, 2016

Related U.S. Application Data

(60) Continuation of application No. 14/337,647, filed on Jul. 22, 2014, now Pat. No. 9,161,568, which is a continuation of application No. 13/863,824, filed on Apr. 16, 2013, now Pat. No. 8,783,266, which is a continuation of application No. 13/305,826, filed on Nov. 29, 2011, now Pat. No. 8,418,698, which is a continuation of application No. 12/782,112, filed on May 18, 2010, now Pat. No. 8,066,012, which is a continuation of application No. 12/539,346, filed on Aug. 11, 2009, now Pat. No. 7,717,119, which is a continuation of application No. 11/058,916, filed on Feb. 15, 2005, now Pat. No. 7,571,730, which is a (Continued)

(51) Int. Cl.

| | |
|---|---|
| ***A24B 15/22*** | (2006.01) |
| ***A24D 1/02*** | (2006.01) |
| ***A24C 5/40*** | (2006.01) |
| ***A24D 1/00*** | (2006.01) |
| ***A24C 1/26*** | (2006.01) |

(52) U.S. Cl.

CPC ..... *A24D 1/02* (2013.01); *A24C 1/26* (2013.01); *A24C 5/40* (2013.01); *A24D 1/00* (2013.01)

(58) Field of Classification Search

None

See application file for complete search history.

(56) References Cited

U.S. PATENT DOCUMENTS

| | | | |
|---|---|---|---|
| 191,501 | A | 5/1877 | Willis |
| 200,889 | A | 3/1878 | Bishop |

(Continued)

FOREIGN PATENT DOCUMENTS

| | | |
|---|---|---|
| DE | 352277 | 4/1922 |
| GB | 1230576 | 5/1971 |

OTHER PUBLICATIONS

Declaration Under 37 C.F.R. § 1.132 executed by Daniel S. Sinclair, Jr. on Aug. 8, 2002, filed in U.S. Appl. No. 10/083,671, for "Tobacco Product".

*Primary Examiner* — Phu Nguyen

(74) *Attorney, Agent, or Firm* — Garvey, Smith, Nehrbass & North LLC; Brett A. North

(57) ABSTRACT

A tobacco product is formed by rolling moistened tobacco leaves about a cylindrical form casing and allowing the leaves to dry to form a shell. After the form casing is removed a consumer can fill the shell with crushed tobacco leaves of a favorite blend, thereby eliminating some steps in the making of a "roll-your-own" tobacco product.

15 Claims, 1 Drawing Sheet

Related U.S. Application Data division of application No. 10/361,985, filed on Feb. 11, 2003, now Pat. No. 6,854,471, which is a division of application No. 10/090,932, filed on Mar. 5, 2002, now Pat. No. 6,526,986, which is a continuation of application No. 09/944,979, filed on Aug. 31, 2001, now Pat. No. 6,357,448, which is a division of application No. 09/456,738, filed on Dec. 7, 1999, now Pat. No. 6,321,755.

(56) References Cited

U.S. PATENT DOCUMENTS

| | | | |
|---|---|---|---|
| 304,582 | A | 9/1884 | Thoss |
| 389,975 | A | 9/1888 | Riedel |
| 657,403 | A | 9/1900 | Brul |
| 663,073 | A | 12/1900 | Coughtry |
| 725,671 | A | 4/1903 | Butler |
| 1,104,779 | A | 7/1914 | Cooley |
| 1,223,362 | A | 4/1917 | Bock |
| 3,385,302 | A | 5/1968 | Wattenford |
| 3,580,433 | A | 5/1971 | Kastner |
| 4,452,257 | A | 6/1984 | Cartwright et al. |
| 5,147,463 | A | 9/1992 | Eilerman et al. |
| 5,645,089 | A | 7/1997 | Burger et al. |
| 5,762,074 | A | 6/1998 | Garner |
| 5,782,246 | A | 7/1998 | Axelrod |
| 6,164,443 | A | 12/2000 | Mitchell et al. |
| 6,321,755 | B1 | 11/2001 | Sinclair, Jr. |
| 6,357,448 | B1 | 3/2002 | Sinclair, Jr. |
| 6,526,986 | B1 | 3/2003 | Sinclair, Jr. |
| 6,742,525 | B2 | 6/2004 | Sinclair, Jr. |
| 6,854,471 | B1 | 2/2005 | Sinclair, Jr. |
| 7,377,281 | B2 | 5/2008 | Bachmann |
| 7,543,590 | B2 | 6/2009 | Sinclair, Jr. et al. |
| 7,571,730 | B2 | 8/2009 | Sinclair, Jr. |
| 7,604,008 | B2 | 10/2009 | Gomez |
| 7,717,119 | B1 | 5/2010 | Sinclair, Jr. |
| 7,987,858 | B2 | 8/2011 | Sinclair, Jr. |
| 8,578,944 | B2 | 11/2013 | Sinclair, Jr. |
| 9,161,568 | B2 * | 10/2015 | Sinclair ..... A24C 5/40 |
| 2005/0039766 | A1 | 2/2005 | Sinclair, Jr. |
| 2005/0188997 | A1 | 9/2005 | Sinclair, Jr. |
| 2006/0000481 | A1 | 1/2006 | Sinclair, Jr. |
| 2008/0142025 | A1 | 6/2008 | Sinclair |
| 2009/0145447 | A1 | 6/2009 | Sinclair, Jr. |
| 2009/0308406 | A1 | 12/2009 | Sinclair, Jr. et al. |

* cited by examiner

TOBACCO PRODUCT

CROSS-REFERENCE TO RELATED APPLICATIONS

This is a continuation of U.S. patent application Ser. No. 14/337,647, filed Jul. 22, 2014 (issued as U.S. Pat. No. 9,161,568 on Oct. 20, 2015), which is a continuation of U.S. patent application Ser. No. 13/863,824, filed Apr. 16, 2013 (issued as U.S. Pat. No. 8,783,266 on Jul. 22, 2014), which is a continuation of U.S. patent application Ser. No. 13/305,826, filed Nov. 29, 2011 (issued as U.S. Pat. No. 8,418,698 on Apr. 16, 2013), which is a continuation of U.S. patent application Ser. No. 12/782,112, filed May 18, 2010 (now U.S. Pat. No. 8,066,012, issued on Nov. 29, 2011), which is a continuation of U.S. patent application Ser. No. 12/539,346, filed Aug. 11, 2009 (now U.S. Pat. No. 7,717,119, issued on May 18, 2010), which is a continuation of U.S. patent application Ser. No. 11/058,916, filed Feb. 15, 2005 (now U.S. Pat. No. 7,571,730, issued on Aug. 11, 2009), which is a divisional of U.S. patent application Ser. No. 10/361,985, filed Feb. 11, 2003 (now U.S. Pat. No. 6,854,471, issued on Feb. 15, 2005), which is a divisional of U.S. patent application Ser. No. 10/090,932, filed Mar. 5, 2002 (now U.S. Pat. No. 6,526,986, issued on Mar. 4, 2003), which is a continuation of U.S. patent application Ser. No. 09/944,979, filed Aug. 31, 2001 (now U.S. Pat. No. 6,357,448, issued on Mar. 19, 2002), which is a divisional of U.S. patent application Ser. No. 09/456,738, filed Dec. 7, 1999 (now U.S. Pat. No. 6,321,755, issued on Nov. 27, 2001).

Each of the above referenced applications are incorporated herein by reference and priority to each is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The present invention relates to tobacco products, and more particularly to a cigar shell for "roll your own" tobacco products.

In recent years, smoking of cigars has become in vogue, and numerous cigar shops opened around the world to satisfy this growing trend. The variety, quality and size of ready-made cigars satisfy the majority of the public. However, a small segment of connoisseurs insist that nothing can compare with the taste and smell of custom-blended tobacco products. These knowledgeable individuals are very selective in the manner their cigars are rolled and in the grade of tobacco used.

A still smaller segment of cigar aficionados prefers to roll their own cigars. They buy tobacco leaves or cigar wrapping and use their preferred brand of crushed tobacco. Some people buy inexpensive cigars, cut them with a sharp blade along the side and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the "stuffing." The edges are then sealed with a liquid or honey, and a new cigar is ready for a smoke.

Some reports indicate that the roll-your-own tobacco market is flourishing. In some countries, the roll-your-own products now hold a substantial share of the tobacco market, and their consumers represent more than 10% of the smoking population. This may be explained by the ability of a consumer to create a tailor-made product, as opposed to commercially available types of cigars.

A disadvantage of the existing method of making such custom-made cigars is that a consumer has to be skillful in the rolling of cigars, that is to have a certain finger dexterity, which would allow him to make the cigar shell without crushing the tobacco leaves. Inexperienced people often become frustrated when the finished product collapses because the cigar was not properly rolled.

The present invention contemplates provision of a tobacco product, or shell, for rolling a custom-made cigar and a method of making the shell.

SUMMARY OF THE INVENTION

It is, therefore, an object of the present invention to provide a device for making a tobacco shell.

It is another object of the invention to provide a method of making a shell suitable for use in rolling a custom-made cigar.

It is a further object of the present invention to provide a method of making a shell for a custom-rolled cigar.

These and other objects of the invention are achieved through a provision of a shell that eliminates some steps in the making of a "roll-your-own" tobacco product. Wrapping moistened tobacco leaves around a cylindrical form casing forms the shell. The leaves are allowed to dry, and the shell is ready for sale to a consumer. After the form casing is removed, the consumer can fill the shell with a favorite blend of tobacco.

In one of the embodiments, a longitudinal slit is formed through a wall of the shell to allow prying open of the shell body and removal of the form casing. After crushed tobacco leaves are deposited into the central opening of the shell, the edges of the slit are moistened and brought together to seal the slit. A cigar is ready for smoking.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 2:
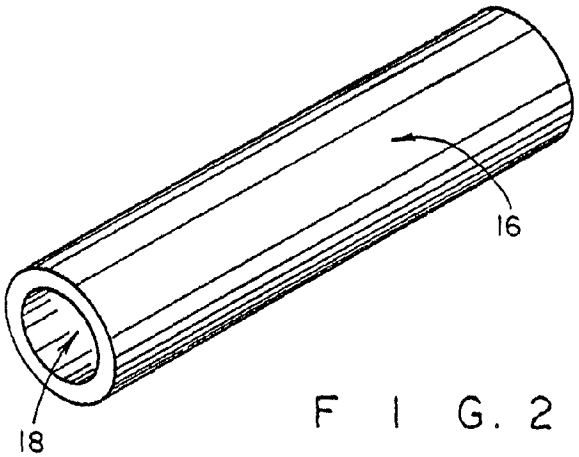
FIG. 2 is a perspective view of the form casing for use in the method of the present invention.

Turning now to the drawings in more detail, numeral 10 designates a tobacco product shell of the present invention. The shell 10 is formed as a generally cylindrical hollow body with a central opening 12 extending along the shell's longitudinal axis. The shell 10 can be made in any desired length and with a predetermined diameter. A longitudinal slit 14 extends through a wall of the shell body; the purpose of the slit 14 will be explained in more detail hereinafter.

A form casing 16 is provided for the practice of the invention. The form casing 16 is formed from a rigid material in a form of a cylinder of a predetermined length and outer diameter. The form casing 16 can be made either hollow, with a central opening 18, or as a solid body. It is desirable that the form casing be inflexible and strong enough to withstand forces applied to the form casing 16 when a cigar shell 10 is rolled.

To form a shell 10, an operator selects the appropriate form casing 16 from a set of casings that may be available in the shop. Tobacco leaves are prepared for rolling by application of a small amount of moisture to the leaves in order to make them more pliable. The operator carefully wraps the tobacco leaves about the outer surface of the form casing 16, slightly compressing the leaves to cause them to adhere together.

The next step involves rolling of the form casing 16 with a tobacco leaf wrapped about it on a hard level surface, such a worktable. The steps of wrapping and rolling continue until the necessary layers of tobacco leaves have been rolled to form a shell 10 of a desired thickness.

It is known that wet tobacco leaves tend to adhere to each other. Therefore, subsequent application of moisture, in many cases, may not be necessary. Still, if the leaves become brittle and there exists a danger of breaking the shell 10, the operator applies moisture to the leaves to retain their pliability.

Once the shell 10 has been created, the operator allows the shell to remain wrapped around the form casing 16 until dry. Cutting through the wall of the shell 10 with a sharp knife or a razor then makes the slit 14. A finished shell 10 is then removed from the form casing 16 and is wrapped either in cellophane or another similar type of outer wrapper.

To facilitate disengagement of the shell 10 from the form casing 16, an outer surface of the form casing 16 may be pre-coated with a non-stick material. In this manner, the danger of an operator damaging the shell 10 is minimized. The non-stick coating may be of a permanent type or applied immediately before wrapping of the tobacco leaves. It is important to select a coating material that would not leave an undesirable taste or odor on the tobacco leaves. A polytetrafluoroethylene (such as that sold under the trademark Teflon®) coating may serve well for this purpose.

The finished shells 10 can be packaged in conventional containers and sold directly to customers who desire to roll their own cigars, but do not have the required finger dexterity. An ultimate user will remove the shell 10 from its outer wrapper (not shown) and pry the shell 10 open by forcing the shell apart along the slit. The user will then fill the interior opening 12 with any desired blend of the favorite tobacco and seal the slit 14 by applying a small amount of moisture to the edges of the slit 14 and bringing the edges together. A small amount of pressure may be applied to the shell 10 to cause sealing of the slit 14. In this manner, a custom-tailored cigar is made, answering all requirements of a connoisseur as to the tobacco blend, size and length of a cigar.

If desired, a kit for roll-your-own tobacco products can be manufactured and sold through tobacconists and specialty shops. The kit would contain a set of form casings 16, an initial supply of tobacco wrapping leaves for the making of the shell 10 and a set of instructions. The user will be able to make individual shells in privacy, at the most convenient time for the user time. In this way, the formed shells will be always the freshest.

In the alternative, a special wrapping material may be used for making of the shells. This material is available on the market; it is made of homogenized tobacco paper that can be wrapped about the form casing 16.

It is also possible to make the form casings 16 disposable. With this method, the shell 10 will remain wrapped about the form casing 16 until such time as a smoker desires to make a cigar. The wrapped shell 10 is then peeled off the form casing 16 and used in a conventional manner. The benefit of such a method is that the danger of a shell collapsing during shipment is eliminated.

Figure 1:
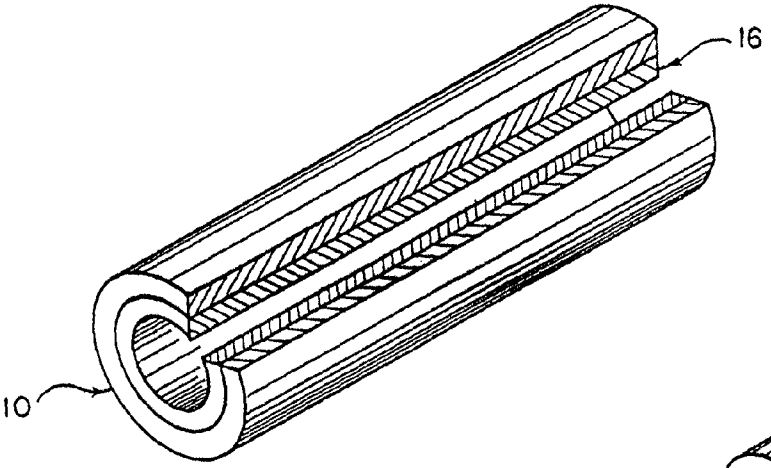
FIG. 1 is a perspective, partially cross-sectional view of the shell in accordance with the present invention wrapped about a form casing.
Figure 3:
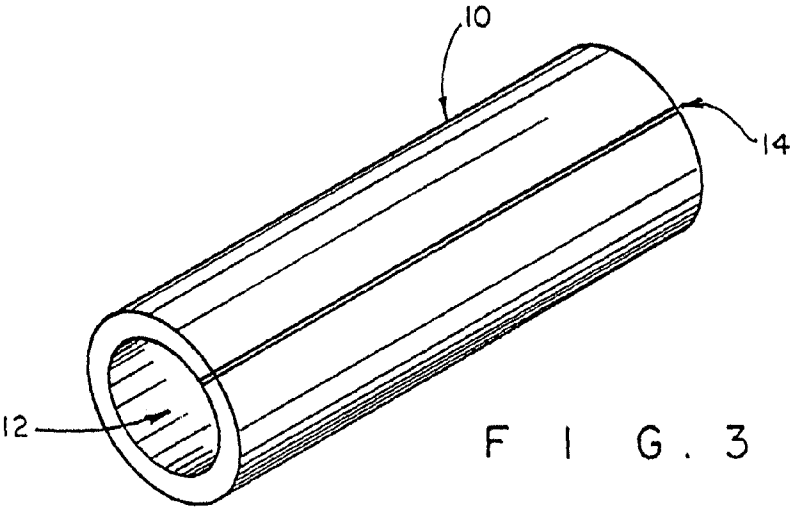
FIG. 3 is a perspective view of the shell made in accordance with the present invention.

Still another approach would be to use a rigid core form casing 16 with a non-stick coating on the outer surface and a secondary form casing made of cardboard that is slipped over the first form casing. The tobacco leaves are wrapped about the second cardboard form casing to make a shell. A cellophane sleeve is slipped over the finished shell and the first inner form casing is removed. The hardened shells with the cardboard form casing are shipped for sale. In that case, the finished product would look very much similar to the view shown in FIG. 1, except that the form casing 16 will be made of a cardboard material.

Stuffing of crushed tobacco into the cigars can be accomplished using a conventional funnel, the nose of which is lightly smaller than the diameter of the inner opening of the shell. The funnel, if desired, can be made a part of the kit containing one master form casing and a plurality of cardboard form casings. In such instance, the slit 14 may not be required, and the shell 10 will be constructed as a hollow cylindrical body with a slit-free sidewall.

Many changes and modifications can be made in the present invention without departing from the spirit thereof. I, therefore, pray that my rights to the present invention will be limited only by the scope of the appended claims.

The invention claimed is:

1. A product for forming a cigar comprising:

a) a sheet of packaging material with first and second edges, the sheet of material being rolled into a tube with a longitudinal bore, the rolled sheet having first and second edges and a longitudinal opening for adding smokable fill material to the bore, and edges that can be moved apart so that smokable fill material can be added to the bore via the longitudinal opening; and b) a packaging, wherein:

the rolled sheet is packaged in the packaging, and the rolled sheet remains rolled in a tube shape inside the packaging, and the rolled sheet is not filled with smokable fill material to form a complete cigar.

2. The product of claim 1, wherein a form casing supports the rolled sheet in a tube shape.

3. The product of claim 2, wherein the sheet is rolled about the form casing further comprising moisture in the sheet of material.

4. The product of claim 1, wherein the sheet is entirely comprised of tobacco material.

5. The product of claim 1, wherein the rolled sheet is comprised of homogenized tobacco.

6. The product of claim 1, wherein the rolled sheet is comprised of natural tobacco leaves.

7. The product of claim 1 wherein the tube is not formed by removing the combustible filler of an existing prefabricated cigar.

8. The product of claim 1 wherein multiple layers define the sheet of material.

9. A product including a cigar tube for holding an end user's tobacco fill material, comprising:

a smokable tube comprising a sheet of material, the sheet of material being rolled into a shaped tube that has a longitudinal bore, a longitudinal opening in the sheet of material for adding smokable fill material to the bore, and edges that can be moved apart so that smokable fill material can be added to the bore via the longitudinal opening in the sheet of material; and a packaging, wherein:

the cigar tube is packaged in the packaging, and the tube remains rolled in a tube shape inside the packaging after packaging.

10. The product of claim 9 further comprising moisture in the sheet of material.

11. The product of claim 9 wherein the sheet is entirely comprised of tobacco material.

12. The product of claim 9 wherein the wrapper is of cellophane material.

13. The product of claim 9 wherein the wrapper is of a clear material.

14. The product of claim 9 wherein the wrapped, shaped tube does not contain any tobacco fill material.

15. The product of claim 9 wherein the tube is not formed by removing the combustible filler of an existing prefabricated cigar.

* * * * *